US007758959B2

(12) United States Patent
Lambert et al.

(10) Patent No.: US 7,758,959 B2
(45) **Date of Patent: *Jul. 20, 2010**

(54) SYNTHETIC, FLAME-RESISTANT YARNS, FIBRES AND FILAMENTS

(75) Inventors: André Lambert, Reventain-Vaugris (FR); Alexis Ponnouradjou, Paris (FR); Lorraine Leite, Paris (FR); Jean-Emile Zanetto, Paris (FR)

(73) Assignee: Rhodia Chimie, Aubervilliers (FR)

( * ) Notice: Subject to any disclaimer, the term of this patent is extended or adjusted under 35 U.S.C. 154(b) by 627 days.

This patent is subject to a terminal disclaimer.

(21) Appl. No.: 10/560,762

(22) PCT Filed: Jun. 25, 2004

(86) PCT No.: PCT/FR2004/001612

§ 371 (c)(1),
(2), (4) Date: Jul. 20, 2006

(87) PCT Pub. No.: WO2005/001173

PCT Pub. Date: Jan. 6, 2005

(65) Prior Publication Data

US 2006/0251895 A1 Nov. 9, 2006

(30) Foreign Application Priority Data

Jun. 27, 2003 (FR) ..... 03 07825

(51) Int. Cl.
*B32B 3/26* (2006.01)
*C09K 21/02* (2006.01)
*C09K 21/04* (2006.01)
*C09K 21/12* (2006.01)

(52) U.S. Cl. ..... 428/364; 428/378; 428/391; 428/392; 428/394; 428/395; 428/396; 428/307.3; 428/307.7; 428/312.2; 428/312.6; 428/318.4; 428/304.4; 428/321.1; 252/601; 252/609

(58) Field of Classification Search ..... 260/DIG. 24; 428/403, 404; 523/202, 205; 524/414, 115, 524/151, 139
See application file for complete search history.

(56) References Cited

U.S. PATENT DOCUMENTS

| | | | | | |
|---|---|---|---|---|---|
| 4,233,199 | A * | 11/1980 | Abolins et al. | ..... | 524/139 |
| 5,928,785 | A * | 7/1999 | Nishida et al. | ..... | 428/372 |
| 6,025,421 | A * | 2/2000 | Atarashi et al. | ..... | 524/151 |
| 2006/0100325 | A1 * | 5/2006 | Leite et al. | ..... | 524/115 |

FOREIGN PATENT DOCUMENTS

| | | | |
|---|---|---|---|
| JP | 07145511 | A * | 6/1995 |
| JP | 2003166124 | A * | 6/2003 |

OTHER PUBLICATIONS

Mehta, Rakesh. Physical Constants of Various Polyamides. Polymer Handbook. Brandrup, J.; Immergut, Edmund H.; Grulke, Eric A.; Abe, Akihiro; Bloch, Daniel R. (4th Edition). (pp. V121-133). John Wiley & Sons, 1999. Online version available at: http://www.knovel.com/knovel2/Toc.jsp?BookID=1163&VerticalID=0.*

Rouette, Hans-Karl Encyclopedia of Textile Finishing. (pp. 263). Woodhead Publishing, 2001. Online version available at: http://www.knovel.com/knovel2/Toc.jsp?BookID=1225&VerticalID=0.*

Rosato et al., Plastics Engineering, Manufacturing and Data Handbook, Kluwer Academic Publishers, 2001.*

* cited by examiner

*Primary Examiner*—Jennifer A Chriss
(74) *Attorney, Agent, or Firm*—Buchanan Ingersoll & Rooney PC

(57) ABSTRACT

The present invention relates to yarns, fibres or filaments made of thermoplastics and to their manufacture. It relates more particularly to yarns, fibres or filaments exhibiting good fire resistance properties and to processes for the manufacture of these articles. These yarns or fibres made of polymer are obtained by spinning a polymer comprising an additive possessing flame-retardant properties composed of at least particles of a solid substrate on which a flame-retardant compound is adsorbed.

12 Claims, No Drawings

SYNTHETIC, FLAME-RESISTANT YARNS, FIBRES AND FILAMENTS

This application is an application under 35 U.S.C. Section 371 of International Application Number PCT/FR2004/001612 filed on Jun. 25, 2004.

The present invention relates to yarns, fibres or filaments made of thermoplastics and to their manufacture.

It relates more particularly to yarns, fibres or filaments exhibiting good fire resistance properties and to processes for the manufacture of these articles.

In the field of clothing or of surface coatings, such as wall, floor, ceiling or other coatings, yarns, fibres or filaments made of thermoplastic are increasingly used for the preparation of articles, such as woven articles, knitted articles, nonwoven articles, tufted surfaces or the like.

For some uses, these articles are required to exhibit increasingly better fire resistance or flame retardancy properties.

The term "fire resistance" is understood to mean mainly a property of extinguishing and of not propagating the combustion of the article. This property is illustrated in particular by standardized tests, such as, for example, for measuring this property on moulded articles, the "UL94" (Underwriters Laboratories) test or, for textile articles, that is to say woven, knitted, tufted, flocked or nonwoven surfaces, tests such as that described in Standard EN533, Standard NF G07-128 of December 1978, Standard ADB0031, published on Feb. 22, 2001, Standard AITM 2.0007 B, Standard AITM 2.0003 or Standards NF P92.504/501/503/507, which are applicable in particular in the building sector.

Numerous techniques have been provided for manufacturing flame-retardant articles from yarns, fibres or filaments made of synthetic material.

Thus, provision has been made to add organophosphorus compounds to the thermoplastic before converting it to yarns or fibres.

However, it is difficult to add such compounds as the temperature for conversion of the thermoplastics is very high, generally greater than 250° C. Furthermore, the addition of these additives to a viscous medium at high temperature greatly restricts the choice of the suitable additives.

Provision has also been made to treat the articles or surfaces with compositions or finishes comprising flame-retardant compounds or additives which are deposited on the surface of the yarns or fibres constituting the said articles or surfaces or are trapped within the structure of these articles.

However, this solution requires a specific treatment of the surfaces and in particular the compounds thus deposited or trapped are capable of being removed during cleaning operations on the articles or surfaces.

One of the aims of the present invention is to overcome these disadvantages by providing yarns, fibres or filaments made of thermoplastic which exhibit good and permanent fire resistance properties. In addition, the process for the manufacture of these yarns, fibres and filaments is conventional and makes it possible to use numerous flame-retardant additives which could not be employed in the techniques of the prior art.

One of the first objects of the invention is to provide a yarn, fibre or filament made of polymer comprising an additive possessing flame-retardant properties composed of at least particles of a solid substrate on which a flame-retardant compound is adsorbed.

The term "adsorbed" is understood to mean that the flame-retardant compound is bonded at least temporarily to the solid substrate by any type of bond, such as absorption in the porous structure of the particle, if this structure exists, wetting or adsorption of the flame-retardant compound at the surface of the particles by at least one layer of the flame-retardant compound, or fixing or grafting of the flame-retardant compound to the surface of the particles by chemical or physico-chemical bonds.

Thus, such adsorption or fixation is facilitated by the choice of a solid substrate exhibiting surface properties compatible with the properties of the flame-retardant compound. For example, a substrate possessing a hydrophilic surface property is advantageously combined with a flame-retardant compound possessing a hydrophilic nature, and conversely for the compounds possessing a hydrophobic nature.

Furthermore, the particle of the solid substrate can advantageously comprise elements or radicals which promote the adsorption of the flame-retardant compound at the surface of the said particle.

According to a preferred characteristic of the invention, the concentration by weight of flame-retardant additive is between 0.5% and 25% with respect to the weight of final composition, advantageously between 1% and 10%.

The term "solid substrate" is understood to mean preferably an inorganic substrate which is solid at the temperature for conversion of the polymers.

Mention may be made, as inorganic substrate which is suitable for the invention, of inorganic oxides, such as silica, alumina, zirconia, magnesium oxide, calcium oxide, cerium oxide, titanium oxide, or their mixtures, or inorganic compounds, such as calcium silicate, magnesium silicate or alkaline aluminosilicates.

Among these substrates the preferred are, those which can be dispersed in the thermoplastic in the form of small particles, advantageously in order to obtain dispersed particles exhibiting a diameter of less than 5 μm, and more advantageously still for at least 80% by number of the dispersed particles to exhibit a diameter of less than 1 μm.

Such a dispersion can be obtained by mixing particles already exhibiting such size characteristics into the polymer or more advantageously by using granules or agglomerates of substrates which, after addition to the polymer and under the action of shear forces applied in order to bring about the dispersing, break up to give individual aggregates or particles.

In the latter embodiment, the agglomerates or granules preferably exhibit a high specific surface and a high porosity between the individual aggregates or particles in order to allow the flame-retardant compound to be adsorbed at least at the surface of the aggregates or particles. The aggregates or particles can also exhibit a porosity which allows the flame-retardant compound to be absorbed.

In this embodiment, the mean diameter of the granules or agglomerates is not critical and is advantageously chosen in order to be able to easily handle the additive possessing flame-retardant properties, in particular during its addition to the polymer. In addition, the mean diameter of these granules is also chosen in order to facilitate the addition and the adsorption of the flame-retardant compound, for example in order to prevent sticking between the different granules.

By way of indication, granules with a mean diameter D50 of greater than or equal to 60 μm, advantageously of between 80 μm and 300 μm, are preferred.

Among the inorganic substrates mentioned above, some silicas exhibit these characteristics and are thus particularly preferred.

Thus, some silicas exhibiting the property of dispersing in the form of particles or aggregates with a diameter or size of between 0.01 μm and 1 μm will be preferred in implementing the present invention.

In addition, the inorganic substrates which are particularly suitable for the invention are those, the granules or agglomerates of which exhibit a high porosity and a high specific surface.

Thus, the preferred substrates are those having granules exhibiting a total pore volume of at least 0.5 ml/g, preferably of at least 2 ml/g. This pore volume is measured by the mercury porosimetry method with a Micromeritics Autopore III 9420 porosimeter, according to the following procedure:

The sample is dried beforehand in an oven at 200° C. for 2 hours. The measurements are subsequently carried out according to the procedure described in the handbook supplied by the manufacturer.

The pore diameters or sizes are calculated by the Washburn relationship with a contact angle theta equal to 140° and a surface tension gamma equal to 485 dynes/cm.

Advantageously, the inorganic substrates exhibiting a pore volume of at least 0.50 ml/g for the pores having a diameter of equal to or less than 1 μm are preferred.

According to a preferred embodiment of the invention, the inorganic substrate is a silica, advantageously an amorphous silica. The silicas are obtained by various processes, including two main processes resulting in silicas referred to as precipitated silica and fumed silica. The silica can also be prepared in the gel form.

The silicas exhibiting a specific surface, measured by the TBAC method, of greater than 50 $m^2/g$ are preferred.

Precipitated silicas are preferred as they can be provided in the form of agglomerated particles forming granules with a size from at least 50 μm or greater to 150 μm.

They can be provided in the form of beads or substantially spherical granules obtained, for example, by atomization, as described in European Patent No. 0 018 866. This silica is sold under the generic name of Microperle. Such silicas, which exhibit noteworthy properties of flowability and of dispersability and a high impregnation capacity, are described in particular in European Patents 966 207, 984 773 and 520 862 and International Applications WO 95/09187 and WO 95/09128.

Other types of silicas may be suitable for the invention, such as those described in French Patent Application No. 01/16881, which are pyrogenic silicas or silicas partially dehydroxylated by calcination or surface treatment.

These examples of silicas used as solid inorganic substrate are described only by way of indication and as preferred embodiments. Use may also be made of other silicas obtained by other processes exhibiting porosity and dispersability properties suitable for carrying out the invention.

According to the invention, the flame-retardant additive comprises a flame-retardant compound adsorbed on the particles of inorganic substrate. In a preferred embodiment of the invention, this adsorption is obtained by impregnation of the granules or agglomerates.

This impregnation is carried out by any conventional means the, for example by mixing the substrate with the flame-retardant compound in the liquid state or in the form dispersed or dissolved in a solvent. In the latter case, after impregnation of the substrate, the solvent will be removed by evaporation.

The term "a flame-retardant compound" should be understood as meaning one or more flame-retardant compounds or a mixture of compounds forming a system exhibiting flame-retardant properties.

Suitable flame-retardant compounds include organophosphorus compounds, melamine and melamine derivatives. Suitable organophosphorus compounds include polyphosphate esters, phosphoric esters or phosphonic esters.

Mention may be made, as flame-retardant compounds suitable for the invention, by way of examples, of bis((5-ethyl-2-methyl-2-oxido-1,3,2-dioxaphosphorinan-5-yl)methyl) ester of methylphosphonic acid, alone or as a mixture with (5-ethyl-2-methyl-2-oxido-1,3,2-dioxaphosphorinan-5-yl) methyl ester of methylphosphonic acid, resorcinol bis(diphenyl phosphate), bisphenol A bis(diphenyl phosphate) or polyphosphate esters.

Mention may be made, by way of illustration, of the compounds or compositions sold by Rhodia under the trade name Antiblaze CU or Antiblaze CT or the derivatives of diphenyl phosphate esters sold by Akzo under the name Fyrolflex or Great Lakes Chemical Corp. under the name Rheophos DP. Finally, Daihachi Chemical Industry sells polyphosphate esters under the names CR 741, CR 733 and CR 741S.

As indicated above, these compounds can be directly impregnated on the substrate, such as a silica, for example, or dissolved in a solvent, such as, for example, water or organic solvents, such as ketones, alcohols, ethers, hydrocarbons or halogenated solvents, for example.

Preferably, use is made of a liquid flame-retardant agent. However, it may be preferable, for example to avoid hot impregnation, to dissolve the flame-retardant agent in a solvent. The solid substrate is then impregnated with the solution obtained. In this case, it is possible to remove the solvent by drying.

Preferably, the impregnation is carried out under dry conditions, that is to say that the flame-retardant compound is added gradually to the solid substrate in order to make possible complete impregnation or adsorption. For this, it is necessary for the flame-retardant compound or the solution of the flame-retardant compound to exhibit a satisfactory fluidity. Thus, in order to obtain this level of fluidity, this impregnation or adsorption can be carried out at temperatures higher than ambient temperature and within a range between 20° C. and 200° C., preferably below 100° C.

The solid substrate can also be preheated in the same temperature range to facilitate the impregnation.

The drying may be carried out by any conventional technique known to a person skilled in the art.

The impregnation can be carried out in a single stage or in several successive stages.

The amount of flame-retardant agent impregnated or adsorbed can vary greatly. However, it is limited and at most equal to the amount necessary to fill the total pore volume of the inorganic substrate, in the case of the impregnation of granules or agglomerates exhibiting a porosity. This is because the flame-retardant additive which has to be added to the polymer should preferably be a powder or a solid in the form of granules exhibiting a good fluidity in order to make possible this addition. In the case of the impregnation of particles or aggregates, the amount of flame-retardant compound added is determined in order to obtain an impregnated solid product which can be handled and added to the polymer. Preferably, the concentration by weight of flame-retardant compound in the flame-retardant additive is between 20% and 70% with respect to the flame-retardant additive, advantageously between 20% and 50%.

According to the invention, the said flame-retardant additive is added to the polymer. This addition can be carried out by mixing granules or powders formed of thermoplastic and particles or granules of flame-retardant additive and then melting the mixture with stirring or application of shear forces in order to make possible the dispersion of the flame-retardant additive and, in a preferred embodiment, deagglomeration of the granules of flame-retardant additive.

However, the preferred form of addition of the flame-retardant additive consists in adding the said additive to the polymer in the molten state and in carrying out the mixing by application of shear forces. This mixing is advantageously carried out in a device possessing a single endless screw or twin endless screws.

Other additives can be added to the said mixture, either simultaneously or separately, such as mattifying agents, light or heat stabilizers, pigments or the like.

The mixture of polymer comprising the said additives is fed to spinning devices, generally referred to as spinning packs, comprising, at the outlet of the endless screw, a filter and a spinneret comprising one or more spinneret holes. The yarn, at the outlet of the spinneret, is cooled and then wound up on a bobbin, optionally after having been subjected to drawing, according to conventional processes for the manufacture of filaments.

The winding-up or spinning rate is advantageously greater than 300 m/min and more advantageously still greater than 1000 m/min.

It is also possible to produce the yarns of the invention with other spinning processes, such as wet spinnings, which consist in feeding a solution of the polymer composition comprising the flame-retardant additives to a spinneret and in extracting the solvent at the outlet of the spinneret, either by evaporation or by coagulation.

The process used for the manufacture of the yarns is that compatible with the nature of the polymer.

The polymers suitable for the invention are those generally used for the manufacture of synthetic textile yarns or fibres or yarns, fibres or filaments for industrial applications, in particular thermoplastic polymers.

Mention may be made, as suitable thermoplastics, of:

polyolefins, polyesters, poly(alkylene oxide)s, polyoxyalkylenes, polyhaloalkylenes, poly(alkylene phthalate or terephthalate)s, poly(vinyl acetate)s, poly(vinyl alcohol)s, poly(vinyl halide)s, poly(vinylidene halide)s, polyamides, polyimides, polycarbonates, polymers of acrylic or methacrylic acid, polyacrylates or polymethacrylates, or thermoplastic copolymers comprising at least one monomer identical to any one of the monomers included in the abovementioned polymers, and the copolymers and/or blends.

Preferably, the matrix can be composed of at least one of the following polymers or copolymers: polyesters, polyamides, polyacrylamide, polyacrylonitrile, poly(acrylic acid), ethylene-acrylic acid copolymers, ethylene-vinyl alcohol copolymers, and the polymers of the same family; polyolefins, such as low density poly(ethylene), poly(propylene), chlorinated low density poly(ethylene), poly(styrene) and the polymers of the same family.

The polymers which are particularly preferred in forming the polymer matrix are chosen from the group consisting of: polypropylene, poly(ethylene terephthalate) (PET), such as poly(ethylene terephthalate)s comprising at least 80% of ethylene terephthalate units, copolymers of ethylene terephthalate and of isophtalic 5-sulphonic acid, poly(butylene terephthalate) (PBT), poly(propylene terephthalate) (PPT), aliphatic polyamides and semiaromatic polyamides.

Mention may be made, as particularly preferred polymers of the invention, of semicrystalline or amorphous polyamides, such as aliphatic polyamides, semiaromatic polyamides and more generally the linear polyamides obtained by polycondensation between a saturated aliphatic or aromatic diacid and a saturated aliphatic or aromatic primary diamine, the polyamides obtained by condensation of a lactam or of an amino acid, or the linear polyamides obtained by condensation of a mixture of these various monomers. More specifically, these (co)polyamides can, for example, be poly(hexamethylene adipamide), polycaprolactam, the poly (hexamethylenediamine phthalamide)s obtained from terephthalic and/or isophthalic acid, such as the polyamide sold under the trade name Amodel, or the polymers comprising star or H macromolecular chains and, if appropriate, linear macromolecular chains. The polyamides comprising such star or H macromolecular chains are described, for example, in the documents FR 3743077, FR 2779730, U.S. Pat. No. 5,959,069, EP 0682057 and EP 0832149.

Preferably, the thermoplastic polymer(s) are selected from the group of the (co)polyamides consisting of: polyamide 6, polyamide 6,6, polyamide 4, polyamide 11, polyamide 12, polyamide 4,6, polyamide 6,10, polyamide 6,12, polyamide 6,36, polyamide 12,12, their copolymers and blends, and also the polyesters, such as poly(ethylene terephthalate), poly(butylene terephthalate) and poly(propylene terephthalate).

The thermoplastic matrix can also comprise additives, such as pigments, delustrants, mattifying agents, catalysts, heat and/or light stabilizers, bactericides, fungicides, dyes, hydrophilic agents, hydrophobic agents, and/or acaricides.

The products of the invention are yarns, filaments or fibres which can have a count within a wide range. Thus, these products can have a low count, for example of the order of 1 dtex or less, as far as diameters of the order of a few hundred micrometers.

The yarns, fibres or filaments obtained can be used in any application. More particularly, they can make it possible to produce woven, knitted or tufted textile surfaces or nonwoven surfaces, in combination or not with other non-flame-retardant yarns, fibres or filaments.

These textile surfaces are produced according to the usual techniques known to a person skilled in the art.

The textile surfaces obtained using the yarns, fibres or filaments of the invention exhibit improved flame-retardancy characteristics.

In addition, the yarns, fibres or filaments of the invention and the textile surfaces obtained with these yarns, fibres or filaments can be treated analogously to those not comprising a flame-retardant additive.

The invention will be better illustrated with reference to the examples given below, purely by way of illustration.

EXAMPLE 1

Preparation of a Flame-Retardant Additive, Referred to as A

The silica of high porosity used is a silica sold under the name Tixosil 38X by Rhodia, having a total pore volume of 3.6 ml/g and a working pore volume of 2.0 ml/g. This is a micropearl silica which has an excellent flowability and which does not produce dust.

3.5 kg of the above silica are introduced into a 20 litre jacketed mixer of Lödige type. The silica is heated to 95° C.

The organophosphorus compound, known as Antiblaze 1045, was heated in an oven to increase its fluidity. It is introduced into the silica at a temperature of 99° C. A predetermined amount of Antiblaze 1045 is introduced into the silica in order to obtain the desired concentrations of flame-retardant agent which are shown in Table I below.

The final product is subsequently sieved on a 1.25 mm sieve.

It exists in the form of a powder having an excellent flowability similar to the starting micropearl silica Tixoxil 38X without dusting of the product.

EXAMPLE 2

Spinning of Polyamide Composition Comprising the Flame-Retardant Additive A

A powder formed of polycaprolactam exhibiting a viscosity number of 140 ml/g, measured in 90% formic acid at a temperature of 25° C., is mixed with an amount of flame-retardant additive A. The mixture of powders, after drying in an oven, is fed to a twin-screw extruder with a diameter of 18 mm. The mixture is melted in the extruder and is fed under pressure to a spinneret comprising 10 holes with a diameter of 0.4 mm and a length of 1.6 mm. The material throughput in the spinneret is approximately 1.0 kg/h. The filaments exiting from the spinneret head are made to converge and the yarn obtained is taken up on a bobbin winder exhibiting a speed of 300 m/min.

The results of the various tests carried out with various concentrations of additive A are collated in the appended table:

TABLE I

| Test | Flame-retardant agent/flame-retardant additive (weight %) | Flame-retardant additive/thermoplastic composition (weight %) | Spinning temperature (° C.) | Spinning behaviour | Count (dtex) | Elongation (%) | Tenacity (cN/tex) |
|---|---|---|---|---|---|---|---|
| F1 | 38.65 | 5 | 265 | good | 594 | 167 | 20.6 |
| F2 | 38.65 | 10 | 265 | good | 587 | 188 | 17.3 |
| F3 | 48.58 | 5 | 251 | good | 603 | 227 | 28.4 |
| F4 | 48.58 | 10 | 251 | good | 610 | 61 | 6.8 |
| F5 | 55.75 | 5 | 251 | good | 618 | 124 | 15 |
| F6 | 55.75 | 10 | 251 | good | 621 | 95 | 11.1 |

EXAMPLE 4

Spinning of Polyamide Composition Comprising the Flame-Retardant Additive A

A powder formed of poly(hexamethylenediamine adipamide) exhibiting a viscosity number of 140 ml/g, measured in 90% formic acid at a temperature of 25° C., is mixed with an amount of flame-retardant additive A. The mixture of powders, after drying in an oven, is fed to a twin-screw extruder with a diameter of 18 mm. The mixture is melted in the extruder and is fed under pressure to a spinneret comprising 10 holes with a diameter of 0.4 mm and a length of 1.6 mm. The material throughput in the spinneret is approximately 1 kg/h. The filaments exiting from the spinneret head are made to converge and the yarn obtained is taken up on a bobbin winder exhibiting a speed of 300 m/min.

The results of the various tests carried out with various concentrations of additive A are collated in the appended table II:

TABLE II

| Test | Flame-retardant agent/flame-retardant additive (weight %) | Flame-retardant additive/thermoplastic composition (weight %) | Spinning temperature (° C.) | Spinning behaviour | Count (dtex) | Elongation (%) | Tenacity (cN/tex) |
|---|---|---|---|---|---|---|---|
| F7 | 38.65 | 5 | 290 | good | 570 | 327 | 31.2 |
| F8 | 38.65 | 10 | 292 | good | 555 | 257 | 19.3 |
| F9 | 48.58 | 5 | 289 | good | 585 | 37 | 7.9 |
| F10 | 48.58 | 10 | 289 | good | 585 | 37 | 7.9 |
| F11 | 61 | 5 | 299 | good | 579 | 81 | 12.1 |
| F12 | 61 | 5 | 297 | good | 597 | 28 | 4.6 |

The invention claimed is:

1. Yarns or fibres made of polymer, said polymer being selected from the group consisting of: polyamide 6, polyamide 6,6, polyamide 4, polyamide 11, polyamide 12, polyamides 4,6, polyamide 6,10, polyamide 6,12, polyamide 6,36, and polyamide 12,12, said polymer comprising an additive possessing flame-retardant properties composed of at least particles of a solid substrate on which a flame-retardant compound is adsorbed, wherein said substrate is in the form of porous granules or agglomerates before being added to the polymer and said granules or agglomerates exhibit a pore volume of at least 0.5 ml/g.

2. The yarns or fibres according to claim 1, wherein the flame-retardant additive has a concentration by weight of 0.5% to with respect to the weight of polymer.

3. The yarns or fibres according to claim 1, wherein the solid substrate is an inorganic substrate being silica, alumina, zirconia, magnesium oxide, calcium oxide, cerium oxide, titanium oxide, calcium silicate, magnesium silicate or alkaline aluminosilicates.

4. The yarns or fibres according to claim 1, wherein the flame-retardant additive in the yarns or fibres is composed of particles or aggregates, at least 80% by number of which exhibit a size of less than 1 μm.

5. The yarns or fibres according to claim 1, wherein the granules or agglomerates have a mean diameter (D50) of greater than or equal to 60 μm.

6. The yarns or fibres according to claim 1, wherein the solid substrate is a silica.

7. The yarns or fibres according to claim 6, wherein the silica is in the form of granules or agglomerates exhibiting a specific surface of greater than 50 $m^2/g$.

8. The yarns or fibres according to claim 7, wherein the flame-retardant compound is chosen from the group of the organophosphorus compounds, melamine and melamine derivatives.

9. The yarns or fibres according to claim 8, wherein the organophosphorus compounds are polyphosphate esters, phosphoric esters or phosphonic esters.

10. The yarns or fibres according to claim 1, further comprising an additive selected from the group consisting of pigments, dyes, heat stabilizers, light stabilizers, hydrophilic agents, hydrophobic agents and mattifying agents.

11. The yarns or fibers according to claim 2, wherein the flame retardant additive has a concentration by weight of 1% to 10% by weight with respect to the weight of the polymer.

12. The yarns or fibers according to claim 1, wherein the flame retardant compound comprises bis((5-ethyl-2-methyl-2-oxido-1,3,2-dioxaphosphorinan-5-yl)methyl) ester of methylphosphonic acid, alone or as a mixture with (5-ethyl-2-methyl-2-oxido-1,3,2-dioxaphosphorinan-5-yl)methyl ester of methylphosphonic acid, resorcinol bis(diphenyl phosphate), bisphenol A bis(diphenyl phosphate) or polyphosphate esters.

* * * * *